US005253397A

United States Patent [19]

Neveu et al.

[11] Patent Number: 5,253,397

[45] Date of Patent: Oct. 19, 1993

[54] HYDROENTANGLING MANUFACTURING METHOD FOR HYDROPHILIC NON-WOVENS COMPRISING NATURAL FIBERS, IN PARTICULAR OF UNBLEACHED COTTON

[75] Inventors: Jean-Loup Neveu, Lery; Bernard Louis Dit Picard, St Nicolas du Bosc, both of France

[73] Assignee: Kaysersberg, S.A., France

[21] Appl. No.: 730,828

[22] PCT Filed: Nov. 28, 1990

[86] PCT No.: PCT/FR90/00861

§ 371 Date: Jul. 26, 1991

§ 102(e) Date: Jul. 26, 1991

[87] PCT Pub. No.: WO91/08333

PCT Pub. Date: Jun. 13, 1991

[30] Foreign Application Priority Data

Dec. 1, 1989 [FR] France ..... 89 15892
Jun. 1, 1990 [FR] France ..... 90 06838

[51] Int. Cl.[5] ..... D04H 1/46
[52] U.S. Cl. ..... 28/105; 28/168
[58] Field of Search ..... 28/104, 105, 103, 167, 28/168; 68/205 R; 428/131, 137, 225, 233

[56] References Cited

U.S. PATENT DOCUMENTS

| | | | |
|---|---|---|---|
| 3,494,821 | 2/1970 | Evans | 28/105 |
| 3,616,175 | 10/1971 | Jung | 28/105 |
| 4,024,612 | 5/1977 | Contractor et al. | 28/105 |
| 4,647,490 | 3/1987 | Bailey et al. | 28/105 |
| 4,879,170 | 11/1989 | Radwanski et al. | 28/105 |

*Primary Examiner*—Clifford D. Crowder
*Assistant Examiner*—Amy Brooke Vanatta
*Attorney, Agent, or Firm*—Breiner & Breiner

[57] ABSTRACT

The invention concerns a method for making a non-woven from unbleached cotton or other natural ligno-cellulose fibers comprising a surface layer of substances rendering the fiber hydrophobic and comprising the following stages:

formation of a sheet of unbound fibers on a water-permeable cloth, tangling the sheet fibers by means of a plurality of water jets issuing from arrays of injectors located transversely to the direction of advance of the support, the method being characterized in that the total energy imparted to the sheet by the set of jets is at least equal to a minimum threshold corresponding to the value at which said sheet becomes hydrophilic.

The invention also concerns a hydrophilic non-woven made by hydraulic binding from unbleached cotton or other natural, ligno-cellulose fibers such as flax, hemp or ramie and free of chemical treatment.

10 Claims, 3 Drawing Sheets

Figure 1:
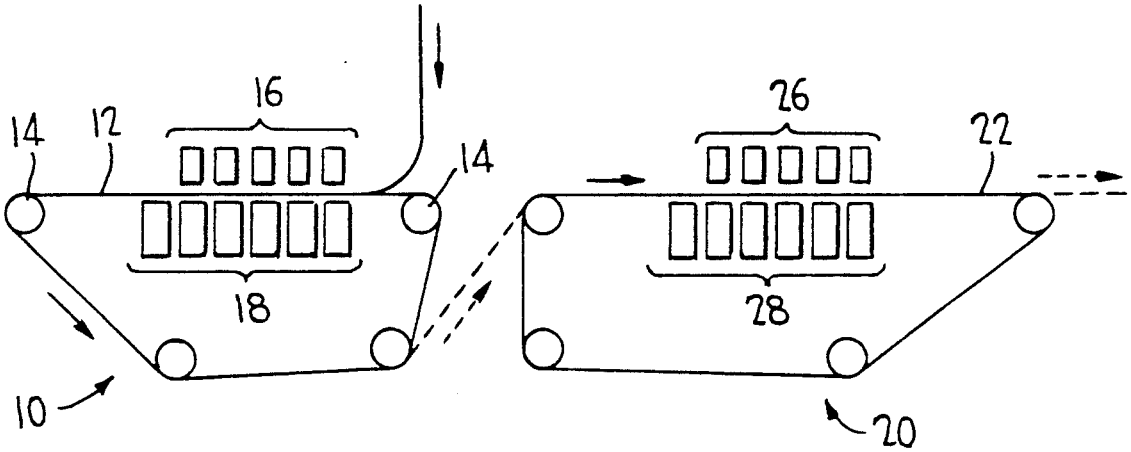

HYDROENTANGLING MANUFACTURING METHOD FOR HYDROPHILIC NON-WOVENS COMPRISING NATURAL FIBERS, IN PARTICULAR OF UNBLEACHED COTTON

The invention concerns the manufacture by hydraulically binding hydrophilic non-wovens based on natural cellulose fibers, for instance from unbleached cotton, flax, hemp or ramie, which were not treated chemically, further to the products made by this method, and to hydrophilic non-wovens comprising chemically untreated natural cellulose fibers.

The purpose of the hydraulic-binding technique is to provide some mechanical strength, independently of any introduction of binder, to a sheet of fibers that initially were not tangled. The binding process consists in subjecting these fibers to very fine pressurized liquid jets, for instance water. As a rule these jets are spaced arrays and are directed at the sheet of fibers which rests on a permeable cloth moving at a specified speed. When moving underneath those arrays, the fibers are driven by the fluid jets passing through the sheet. These jets recoil on the cloth and cause the tangling of the fibers on account of interaction. The links so created ensure the sheet's cohesion.

This procedure makes it possible to make non-wovens from a variety of fibers, whether they be synthetic, natural, long or short, the same or in mixture, chosen in relation to the end use. The products so made as a rule offer superior draping, flexibility and softness to the touch which are superior to those of the non-wovens made by other techniques.

The European patent application 132,028 in particular describes a procedure for making non-wovens from unbleached cotton and consisting in subjecting an initially loose web of unbleached cotton fibers to tangling by water jets which oscillate at low pressure, then in terminating the treatment, prior to drying, by a boiling and bleaching stage of any known technique, for instance by immersion in an autoclave in a solution of caustic soda and oxygenated water at 120° C.

This last stage of the procedure is necessary, according to this patent, because of the use of unbleached cotton. Indeed raw cotton is used, which if cleansed at all was only so mechanically, and of which the fibers comprise a primary coating of waxes and fats that must be eliminated to make the fibers hydrophilic. Accordingly, the object of boiling is to saponify the fats.

The invention is based on the discovery that it is possible, by means of a consolidated water-jet treatment, to impart to a sheet of natural fibers such as of unbleached cotton the property of absorbing liquids, in particular water, in the absence of any chemical treatment.

The method of the invention for making a non-woven from unbleached cotton fibers or other natural lignocellulose fibers with a surface coating rending them hydrophobic, comprises the following stages:

- formation, by any suitable procedure, of a sheet of loose fibers on a water-permeable cloth,
- tangling the sheet's fibers using a plurality of water jets issuing from injector arrays transverse to the direction of motion of the support; it is characterized in that the total energy imparted to the sheet by the set of jets is at least equal to a minimum threshold corresponding to the value at which said sheet becomes hydrophilic.

In particular this threshold depends on the nature and origin of the fibers (new cotton or recovered fibers: stripping, combing noils, etc.), on the sheet structure (superposed card webs, pneumatically made sheets), on the density and thickness of the sheet.

It was found in surprising manner that beyond a given threshold of kinetic energy transmitted by the water jets to the fibers for the purpose of tangling, an action occurs which terminates their initial hydrophobic nature.

Illustratively it was found that for an unbleached cotton from a cotton comber, evincing micronaire number 3 to 5, or new cotton, micronaire 3 to 8, this threshold of injector-dissipated energy is between 0.4 and 1.1 kwh per kg of treated fibers for sheets of which the specific weight is between 25 and 200 g/m$^2$ and preferably between 30 and 100 g/m$^2$.

Illustratively when assessing the wetting ability of an unbleached cotton web by measuring the time it needs to sink into water after having been placed on the water surface, it is impossible to measure said ability for a web of untreated fibers—that is fibers that were not bound by water jets—because the sheet floats on the surface. On the other hand, after the same web has been treated in the manner of the invention, that is after it has absorbed the required minimum of energy, said wettability can be measured.

Without hereby implying restriction to a single interpretation, it appears that the water jets strip the fibers in a mechanical, unexpected and additional way. In surprising manner, beyond a given quantity of absorbed energy, this effect suffices in achieving at least partial detachment of the hydrophobic sheath with possibly release of fibrils, rendering the hydrophilic fiber parts accessible to the liquids, in particular water. Moreover, this stripping entails no degradation at all of the mechanical properties of the resulting non-woven, the product so obtained evincing continuous improvement in tear strength. Be it borne in mind that the treatment does not necessarily eliminate the substances constituting the hydrophobic sheath. These substances may be retained between the fibers or remain caught zone-wise. No substantial change in the chemical functions of the fibers are noted following water-jet treatment, as shown by the infrared peaks, even though the non-woven has become hydrophilic.

Accordingly, the solution of the invention offers the advantage that in a single stage and beginning with unbleached cotton fibers, products bound by water jets can be made which evince pronounced absorption and do not require complex chemical treatment such as boiling to make the fibers hydrophilic.

The method of the invention applies to all ligno-cellulose fibers which in their natural state are hydrophobic because of the presence of fatty or waxy substances at the surface which conventionally are reduced by chemical treatment. Unbleached cotton is the foremost object among the raw materials, however other fibers such as of ramie, hemp or flax for instance are not excluded.

Another advantage is to put to use recovered fibers from weaving wastes for instance; thus the method allows treating fibers that are the residues of combers, i.e., comparatively short fibers with lengths between 5 and 25 mm.

The products made by the method of the invention are widely applicable, for instance in the following fields:

as household or industrial wiping means: cleaning, dishwashing, and scouring rags;

bathroom purposes: gloves, towels;

table linen: sheets, napkins;

bed linen: bed sheets, pillow cases, bolster covers, etc.;

protective wear.

As a rule the product is strong enough for handling, however, the treatment may be continued beyond the minimum threshold for hydrophily until the improvement of the mechanical tear strength reaches a plateau. However, the hydrophilic properties do not increase in the same proportion.

In another object of the invention, a given quantity of synthetic, and in particular binding or thermoplastic fibers can be incorporated into the sheet, said fibers, if called for, after a suitable, thermal and/or mechanical treatment, shall increase the mechanical strength of the non-woven web, in particular in the moist condition.

Illustratively up to 30% polyethylene, polypropylene, or other base thermoplastic fibers may be incorporated and following elimination of the water, the web may be moved into an oven raised to high enough temperature to melt them at least in part. The softened material constitutes the adhesion zones between the cotton fibers after cooling to ambient temperature.

Another object of the invention is a hydrophilic non-woven wherein most of the natural ligno-cellulose fibers are tangled by hydraulic binding and characterized in that said fibers are free of any chemical treatment to make them hydrophilic.

In particular a non-woven of the invention comprises at least 70% of unbleached cotton and is devoid of any wetting agent, surfactant or other. Nevertheless it offers such ability to absorb aqueous liquids that its immersion time, measured by the procedure discussed below, is less than 30 seconds. Moreover, its absorption coefficient exceeds 9 g/g of non-woven.

Lastly, in a particular implementation of the invention, the non-woven comprises up to 30% synthetic fibers.

In another object of the invention, a non-woven is made of which the wettability is further improved by combining the sheet with a foil of cellulose wadding and by subjecting the assembly to hydraulic-binding treatment.

Be it borne in mind that cellulose wadding is absorbing crepe paper for the bathroom or for wiping purposes.

The method is characterised in that:

an unbound sheet is formed which comprises at least 70% unbleached cotton or other natural ligno-cellulose fibers with a surface sheath of hydrophobic substances, said sheet being deposited on a permeable cloth, a first side of said sheet is subjected to water-jet tangling treatment, at least one foil of cellulose wadding is deposited on the second side opposite the first, the second side so clad is subjected to water-jet tangling treatment.

Preferably the sheet consists of 100% unbleached cotton. However, up to 30% synthetic fibers such as thermally binding fibers may be used, that shall reinforce the non-woven following suitable and additional thermal treatment.

Hydraulic binding allows treating sheets with specific weights between 25 and 200 g/m$^2$. Below 25 g/m$^2$, the energy released by the fluid jets would cause substantial fiber displacement and force them to anchor between the meshes of the support cloth. Adhesion to the cloth and undesirable fluff would then be present in the end product. Above 200 g/m$^2$, the thickness is excessive to permit depth treatment of the sheet.

Accordingly, the quantity of paper cellulose fibers that will be incorporated depends on the overall specific weight and on product application in the light of the required mechanical strength. Thus, paper fibers may amount to 10 to 50% of the total weight though not being less than 10 g/m$^2$. Several foils of cellulose wadding may be superposed to arrive at the desired specific weight.

The product made by this method offers substantially improved wettability compared to the non-woven lacking introduction of cellulose fibers. Thus, the immersion time drops from about 30 seconds to less than 10 seconds.

Other features and advantages of the method are elucidated in the description below of two non-limiting implementations of the invention in relation to the attached drawings.

Figure 5:
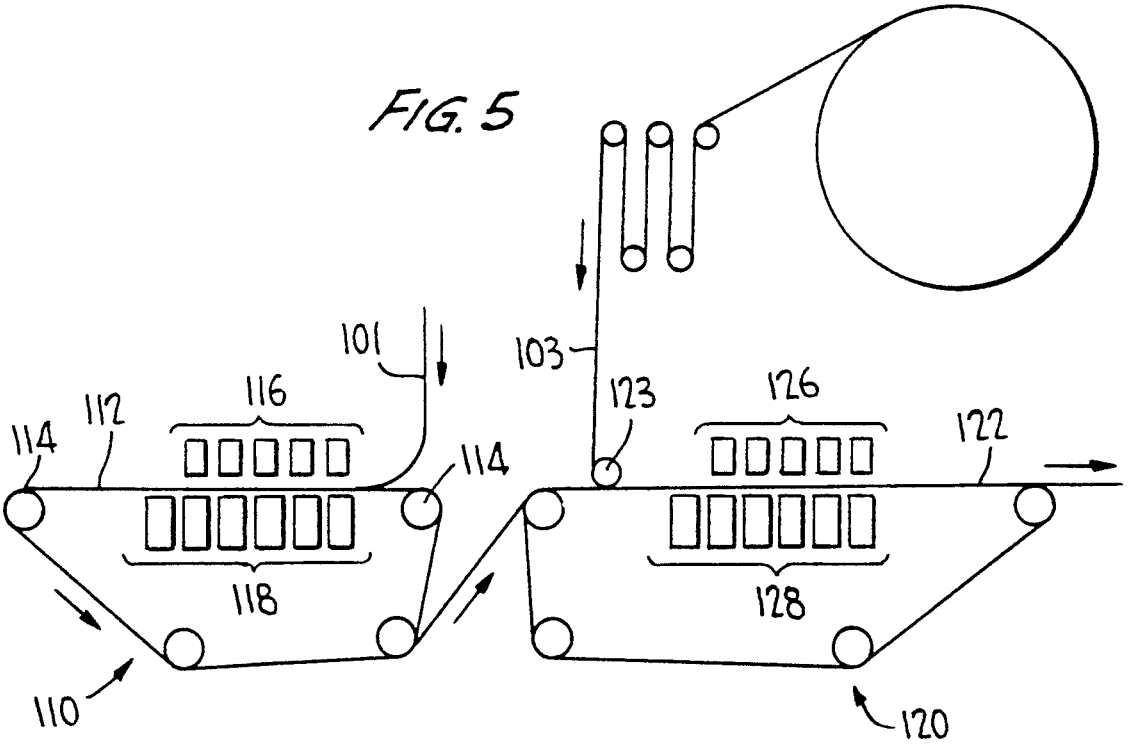
Figure 2:
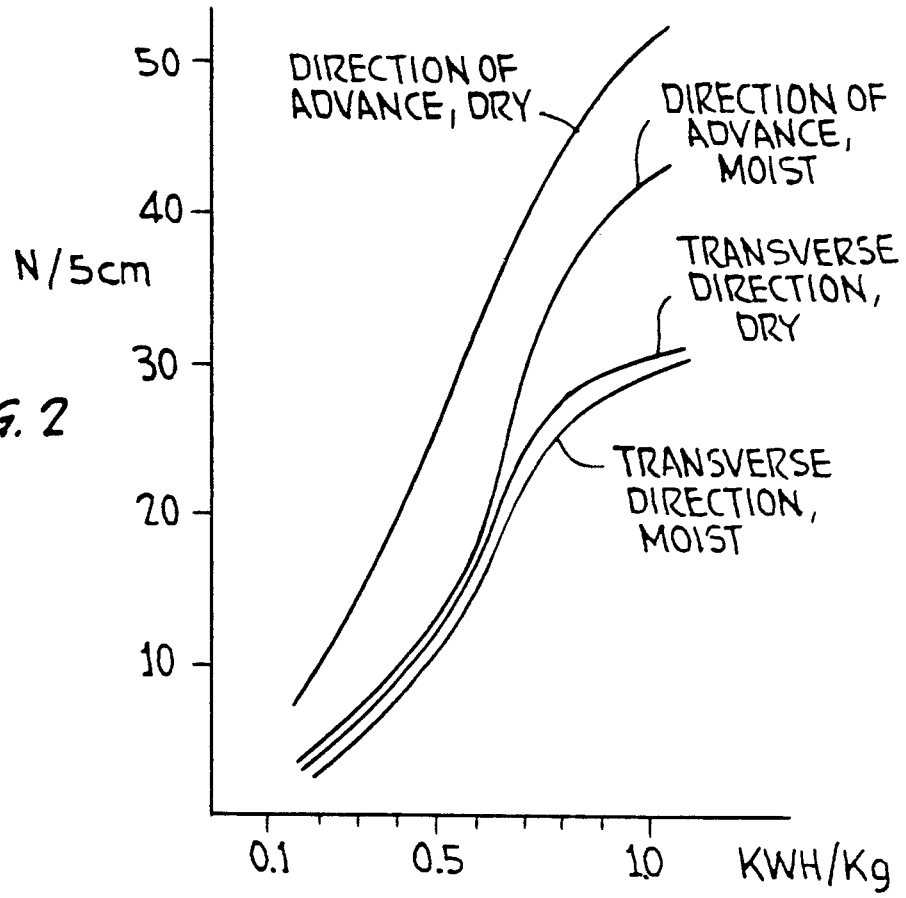
Figure 3:
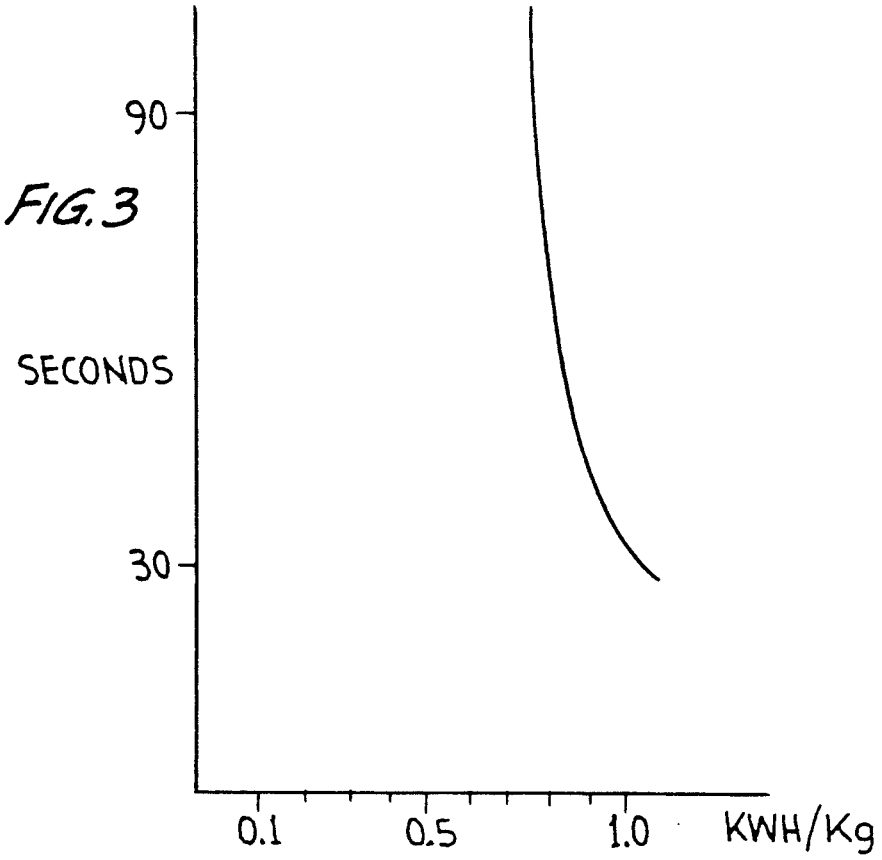
Figure 4A:
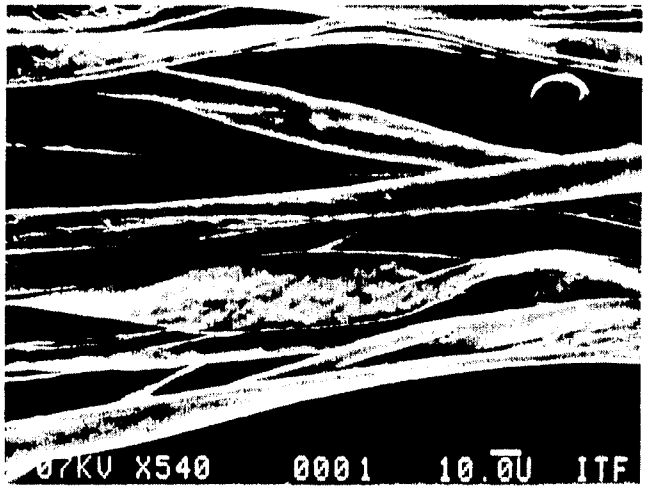
Figure 4B:
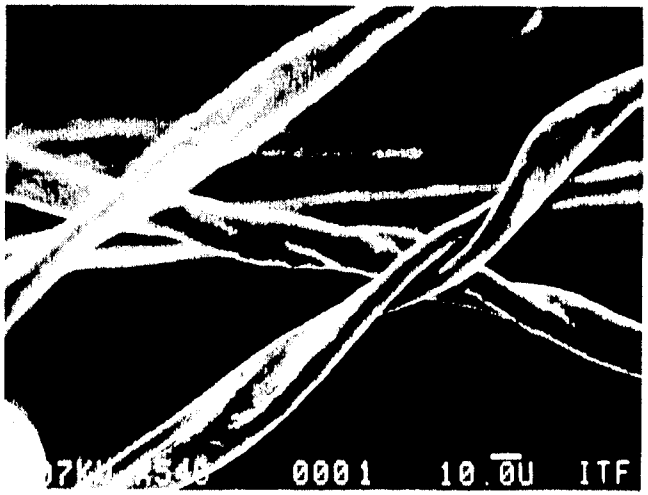
Figure 4C:
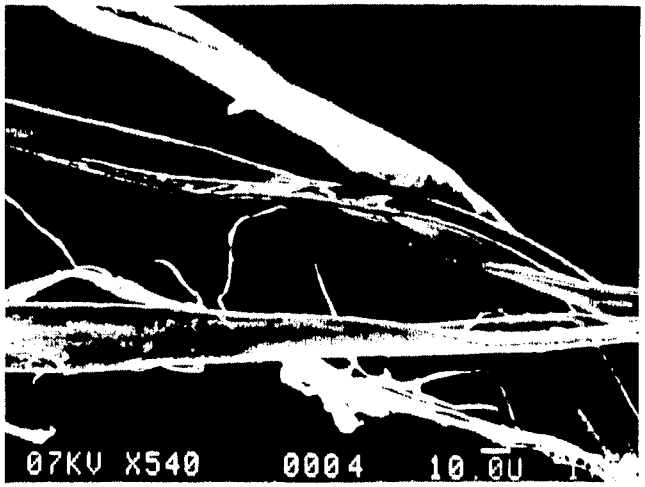
Figure 4D:
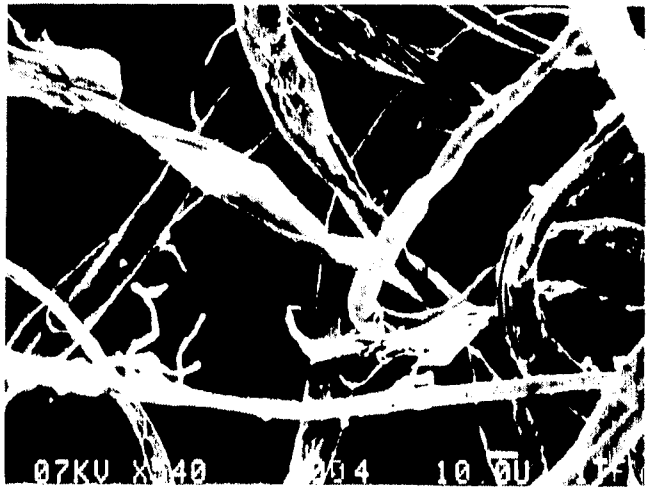

FIG. 1 shows hydraulic binding equipment to implement the method of the invention, FIG. 2 is plot of tear-strength of the treated product as a function of the amount of energy released per kg of treated product by the consecutive injectors, FIG. 3 is a plot of the immersion time of the treated product of the implementation example as a function of the amount of energy released per kg of treated product by the consecutive injectors, FIGS. 4A and 4B are micro-photographs of unbleached cotton fibers before treatment, FIGS. 4C and 4D are microphotographs of the same fibers shown in FIGS. 4A and 4B following treatment of the invention and taken on the non-woven, and FIG. 5 is hydraulic binding equipment for making a non-woven for a second implementation of the invention.

FIG. 1 shows hydraulic binding equipment of the kind developed by Societe PERFOJET. It includes a first hydraulic binding unit 10 with an endless cloth 12 tensioned between horizontal rollers 14 so as to form a loop. The cloth is driven at a predetermined speed in the direction of the arrow. It comprises an upper part near a first set of injector arrays 16 fed with pressurized liquid and pointing vertically at the cloth. The injector arrays are located perpendicularly to the direction of motion of the cloth and comprise injection orifices spread across the entire width of the cloth. The number of arrays varies and may be selected as a function of the desired pressure graduation. Preferably this number shall be between 3 and 10.

Suction boxes 18 located opposite the injector arrays and below the cloth are hooked-up to a vacuum source and serve to recover the water issuing from the injector arrays and having crossed the cloth.

The equipment comprises a second hydraulic binding unit 20 with an endless cloth 22 to treat the second side. This second unit includes a second set of injector arrays 26 fed with pressurized liquid from omitted conduits. The injector arrays are related to suction boxes 28 to recover the liquid after its tangling work.

As shown by the figure, the sheet of fibers is deposited on the cloth 12 from a sheet-forming station omitted from the drawing.

Before being moved to said sheet-forming station, the cotton is cleaned and rid of most of its impurities such as grains, leave debris and dust, by means of conventional textile apparatus such as stripper, gin, etc. The fiber flocks then are moved onto lapping apparatus: card, pneumatic lapper, etc.

Cards of any kind may be used. Preferably a card with a web tangler achieving good ratios of strength for advance to transverse directions shall be used for light non-wovens with specific weights less than 100 g/m$^2$.

The number of webs to be superposed depends on the specific weight per m$^2$ desired. Illustratively 4 webs are superposed for a specific weight of 65 g/m$^2$.

Instead of forming the sheet by carding, pneumatic apparatus of the RANDO type also may be used, in particular for high specific weights up to 200 g/m$^2$.

The sheet so formed is deposited on the cloth 12 moving at a predetermined speed and from there it is driven to the set of injector arrays 16 for the first-side treatment. To ensure pre-wetting the web—which is required because the fibers used are hydrophobic—illustratively an injector may be used of which the pressure has been set low (30 bars) without disturbing the fiber arangements. The other injectors are set at pressures from 40 to 250 bars to assure fiber tangling. Once the web has undergone a first consolidation on the first side, it may be driven to the second binding unit where it is received by a cloth in such a way it presents its second side to the set of injectors 26. In this embodiment, the second side is treated exactly like the first side. The non-woven then passes over a last vacuum slot through which most of the water is evacuated. The non-woven then is dried, for instance by an air drier or drying drums (all omitted). If called for, if thermally binding fibers were incorporated into the web, thermal binding treatment may be applied.

Again, if desired, a hydraulic structuring station obviously may be provided before the drying station.

EXAMPLE 1

A sheet of unbleached cotton fibers of the comber type was treated by this method. The average fiber length was 12 to 14 mm with a micronaire number of 4. The final non-woven had a specific weight of 65 g/m$^2$ and was constituted by 4 superposed card webs.

Each hydraulic binding unit consisted of 4 injectors with respectively pressures of 30, 95, 125 and 125 bars. The table below shows the energy consecutively released by the injectors and measured at the pumps per kg of non-woven; the machine speed was 30 m/min.

| Injectors | Pressure (bars) | Energy/set-of-injectors | Dissipated energy kwh/kg |
|---|---|---|---|
| 1 | 30 | 0.03 | 0.03 |
| 2 | 95 | 0.16 | 0.19 |
| 3 | 125 | 0.19 | 0.38 |
| 4 | 125 | 0.19 | 0.57 |
| 5 | 30 | 0.03 | 0.60 |
| 6 | 95 | 0.16 | 0.76 |
| 7 | 125 | 0.19 | 0.95 |
| 8 | 125 | 0.19 | 1.14 |

A non-woven with the following characteristics was obtained:

weight/m$^2$: 65 g
thickness: 0.42 mm
tear strength of 5 cm wide test sample advance: 55 N; transversely: 33 N
immersion time: 30 seconds
absorption coefficient: >9 g/g.

FIG. 2 shows the web tear-strength as a function of the energy imparted to the sheet by the consecutive injectors. In both the advance and transverse directions, the strength increases with the energy received by the sheet and as regards the transverse direction, the strength reaches a plateau beyond 0.9 kwh/kg of non-woven.

For the embodiment under consideration, FIG. 3 shows the immersion time reflecting wettability as a function of the same amount of energy. The time the sample requires to immerse in the water is measurable beyond a minimum energy threshold which in the example is 0.7 kwh/kg of non-woven.

The table below shows the immersion times of the non-woven of said example on one hand and on the other hand for a non-woven of the same specific weight made by mechanical needling from the same unbleached cotton card webs.

Immersion times in excess of 300 seconds mean that after that time, the non-woven still was floating on the water and was not wetting.

| NON-WOVEN | Injector-released energy kwh/kg | Immersion time (s) |
|---|---|---|
| bound mechanically | — | >>300 |
| bound | 0.03 | >>300 |
| by | 0.19 | >>300 |
| water jets | 0.38 | >>300 |
| | 0.57 | >>300 |
| | 0.60 | >>300 |
| | 0.76 | 95 |
| | 0.95 | 37 |
| | 1.14 | 27 |

Immersion time is used in pharmacopoeia as a measure of wettability of hydrophilic cotton. The procedure is as follows: A previously dried, first cylindrical basket constituted by copper wires about 0.4 mm in diameter is employed. This basket is 8.0 cm high, with a diameter of 5.0 cm and its meshes are 1.5 to 2.0 cm wide. Its weight is 2.7±0.3 g.

The basket is weighed ($m_1$) Then 1 g of non-woven is sampled from five different specimen sites. These 5 g are inserted without compaction into the basket which is then weighed ($m_2$). On the other hand a receptacle 11 to 12 cm in diameter is prepared and filled with water at about 20° C. to about a height of 10 cm. The basket is moved horizontally above the water and is allowed to drop from a height of 10 mm. The time it needs to plunge into the water is carefully recorded. That is the time plotted in FIG. 3.

The absorption coefficient is determined from the above test. The basket is withdrawn from the water and allowed to drain for 30 seconds, whereupon it is deposited into a calibrated container ($m_3$) and the overall system is weighed ($m_4$). The water absorption coefficient per gm of cotton that was cited above is given by the formula $$C=[m_4-(m_2+m_3)]/[m_2-m_1].$$

The scanning electronic microscope pictures show the stripping action of the jets on the primary fiber layer. The microphotographs 4A and 4B show the fibers being smooth and intact prior to treatment, whereas the microphotographs 4C and 4D taken after treatment show the presence of fibrils adhering to the fibers which otherwise have not been degraded.

Infrared spectrophotometry also is carried out.

As regards the infrared peaks, a change was noticed from one spectrum taken before treatment and another after. However, this change is inadequate to allow conclusions on the vanishing of the substances rendering the fibers hydrophobic.

FIG. 5 shows slightly modified equipment for making a non-woven in another implementation of the invention. Components corresponding to those of FIG. 1 are referenced by the same numeral augmented by 100.

The equipment comprises a first hydraulic binding unit 110 with an endless cloth 112 tensioned between horizontal rollers 114 so as to form a loop. It includes an upper portion near a first set of injector arrays 116 fed with pressurized liquid.

The apparatus includes a second hydraulic binding unit 120 with an endless cloth 122 to treat the second surface. It comprises a second set of injector arrays 126 fed through omitted conduits with pressurized liquid. The arrays are associated to suction boxes 128 to recover the liquid following its tangling work.

As shown by the figure, the fiber sheet 101 is deposited on the cloth 112 from an omitted sheet-forming station whence it is driven toward the set of injector arrays 116 to treat a first side. To ensure pre-wetting of the web required by the hydrophobic nature of the fibers being used, illustratively an injector may be used of which the pressure is adjusted low, without disturbing the fiber arrangement. The other injectors are adjusted at pressures varying between 40 to 250 bars to assure fiber tangling. Thereupon, having undergone a first consolidation on the first side, the sheet is turned upside down so as to have its other side face upward as shown in the figure. The sheet is then driven toward the second unit 120 where it receives a foil of cellulose wadding 103 which is applied to its upper side by a compressing roller 123. The foil of cellulose wadding 103 is conventionally fed from a supply roll rotating about a horizontal shaft.

The assembly consisting of 101, 103—wool on top—is driven toward the second set of injector arrays 126 of which the projected fluid jets ensure both the binding of the fibers of the sheet 101, the continued stripping, and the adhesion of the paper fibers 103 into the sheet 101. This sheet 101 acts as a filter and prevents short fibers from being dragged onto the cloth 122 below.

Thereupon the non-woven moves over a last vacuum-slot whereby most of the water can be evacuated. Then the non-woven is dried, for instance with through-flow air, or on a drum drier (omitted). Where called for it may undergo a thermally binding treatment if thermally binding fibers were incorporated into the web.

Furthermore, if desired, a hydraulic structuring station may be provided, of course before drying.

EXAMPLE 2

A non-woven made from a sheet of unbleached cotton fibers of the comber type was manufactured by the above described method. The average fiber length was 12 to 14 mm.

After hydraulically treating a first side of the sheet, this sheet was turned upside down and two foils of cellulose wadding each with a specific weight of 17 g/m$^2$ were deposited on said second side, and the assembly was treated hydraulically. Each hydraulic binding unit consisted of four injectors of which the pressures respectively were 60, 110, 130, 70 bars. The table below lists the energy released by the injectors and measured near the pumps per kg of treated material, the speed of advance being 30 m/min.

| Injectors | Pressure (bars) | Energy per injector array (kwh/kg) | Cumulative dissipated energy (kwh/kg) |
|---|---|---|---|
| 1 | 60 | 0.13 (1) | 0.13 (1) |
| 2 | 110 | 0.35 (1) | 0.48 (1) |
| 3 | 130 | 0.31 (1) | 0.79 (1) |
| 4 | 70 | 0.12 (1) | 0.91 (1) |
| 5 | 60 | 0.07 (2) | 0.57 (2) |
| 6 | 110 | 0.19 (2) | 0.76 (2) |
| 7 | 130 | 0.17 (2) | 0.93 (2) |
| 8 | 70 | 0.06 (2) | 0.99 (2) |

(1) for cotton alone
(2) for the non-woven assembly

Accordingly, the overall energy released by the injectors is 0.99 kwh/kg of non-woven composite. The energy released on the first side to the cotton web alone was 0.91 kwh/kg cotton. On the second side, the energy released on the cellulose wadding plus cotton was 0.49 kwh/kg of non-woven composite.

A non-woven with the following characteristics was made:

weight/m$^2$: 74 g (unbleached cotton 40 g, wadding 34 g)
thickness: 0.53 mm
tear strength of a 5 cm wide sample, dry
  direction of advance: 55 N
  transverse direction: 21 N
tear strength of 5 cm wide sample, moist
  direction of advance: 54 N
  transverse direction: 21 N
elongation at rupture (dry)
  direction of advance: 26%
  transverse direction: 80%
immersion time: 4 to 6 seconds
absorption coefficient: 7.4 g/g Accordingly, the product offers a very short immersion time, about 4 to 6 seconds, compared with an immersion time of 30 seconds for paper fibers, i.e., products without hydrophilic, short, ligno-cellulose fibers.

The immersion time was measured by the same basket procedure as in Example 1. Again the absorption coefficient was measured in the same manner, and, for the present case, it is as a rule less than for a 100% cotton non-woven. The cellulose wadding coefficient itself is less, being about 5 to 6 g/g.

We claim:

1. A method for making a non-woven material, capable of absorbing liquid, from unbleached cotton or other natural ligno-cellulose fibers wherein the fibers have a surface coating of a substance which renders the fibers essentially non-wetting and as having an immersion time in excess of 300 seconds, said method comprising placing said fibers on a water-permeable support member moving in a predetermined direction so as to form a sheet of unbound fibers, entangling the fibers forming the sheet by subjecting a first surface of said sheet to a plurality of water jets issuing from a first set of injectors positioned transverse to the pre-determined direction of movement of the support member, wherein said water jets issue from said injectors so as to impart a kinetic energy to said fibers sufficient to detach said surface coating of said fibers and increase the wettability of the fibers so that the sheet of fibers has an immersion time of less than 30 seconds.

2. A method for making a non-woven material according to claim 1 wherein the kinetic energy imparted is between 0.4 and 1.1 kwh per kg of fibers subjected to the plurality of water jets.

3. A method according to claim 1 or claim 2 wherein said fibers are placed on said support member so that said sheet formed has a specific weight of between 25 and 200 $g/m^2$.

4. A method according to claim 1 wherein a second surface of said sheet is subjected to a plurality of water jets from a second set of injectors following subjecting said first surface of said sheet to said plurality of water jets from said first set of injectors.

5. A method according to claim 1 wherein said first set of injectors issuing said plurality of water jets includes from 3 to 10 injectors.

6. A method according to claim 1 wherein a first injector of said first set of injectors operates at low pressure so as to wet the sheet of fibers without entangling the fibers.

7. A method according to claim 1 or claim 4 wherein said injectors issue said water jets at a pressure of between 40 and 250 bars.

8. A method for making a non-woven material capable of absorbing liquid comprising placing fibers, of which 70% are from unbleached cotton or other natural ligno-cellulose fibers wherein the fibers have a surface coating of a substance which renders the fibers essentially non-wetting and as having an immersion time in excess of 300 seconds, on a water-permeable support member moving in a pre-determined direction so as to form a sheet of unbound fibers; entangling the fibers forming the sheet by subjecting a first surface of said sheet to a plurality of water jets issuing from a first set of injectors positioned transverse to the pre-determined direction of movement of the support member, such that the water jets impart a kinetic energy to said fibers sufficient to detach said surface coating of said fibers and increase the wettability of the sheet so that the sheet has an immersion time of less than 30 seconds; depositing on a second surface of said sheet at least one sheet of cellulose wadding; and subjecting the second surface of said sheet to entangling by subjecting said second surface having said at least one sheet of cellulose wadding deposited thereon to a plurality of water jets issuing from a second set of injectors.

9. A method according to claim 8 wherein said fibers are placed on said support member so that said sheet formed has a specific weight of between 25 and 200 $g/m^2$, and said at least one sheet of cellulose wadding deposited on said second surface has a specific weight exceeding 10 $g/m^2$.

10. A method according to claim 8 wherein the at least one sheet of cellulose wadding deposited on said second surface makes up 10 to 50% by total weight of the non-woven material.

* * * * *